US006061827A

United States Patent [19]

Lampson et al.

[11] Patent Number: 6,061,827

[45] **Date of Patent: *May 16, 2000**

[54] BIB HAVING SIDE EDGES WITH STRESS RELIEF MEANS

[75] Inventors: Patricia L. Lampson; Amit Gupta; Beverly Julian Jackson, all of Cincinnati, Ohio

[73] Assignee: The Procter & Gamble Company, Cincinnati, Ohio

[ * ] Notice: This patent is subject to a terminal disclaimer.

[21] Appl. No.: 09/036,562

[22] Filed: Mar. 9, 1998

[51] Int. Cl.[7] ..... A41B 13/00

[52] U.S. Cl. ..... 2/49.1; 2/49.4

[58] Field of Search ..... 2/48, 49.1, 49.4, 2/50, 51

[56] References Cited

U.S. PATENT DOCUMENTS 4,660,224 4/1987 Ashcraft .

FOREIGN PATENT DOCUMENTS 2565791 12/1985 France .
WO 97/05793 2/1997 WIPO .
WO 98/16126 4/1998 WIPO .

*Primary Examiner*—John J. Calvert
*Assistant Examiner*—Shirra L. Jenkins
*Attorney, Agent, or Firm*—Larry L. Huston; E. Kelly Linman; Donald E. Hasse

[57] ABSTRACT

A bib having a predisposition for folding or bending to conform to the wearer. The predisposition is provided by slits, notches or other features which selectively reduce the cross sectional area of the bib or otherwise provide a hinge line. Preferably, the slits or notches are symmetric relative to the longitudinal centerline of the bib. The reduced cross section may extend essentially continuously across the lateral width of the bib. If desired, the hinge lines may converge as the bottom edge of the bib is approached. Preferably, the hinge lines converge at a common point which intercepts both the longitudinal centerline and the bottom edge of the bib.

11 Claims, 4 Drawing Sheets

BIB HAVING SIDE EDGES WITH STRESS RELIEF MEANS

FIELD OF THE INVENTION

The present invention is related to bibs, and more particularly to a bib having a stress relief means which promotes improved fit during use.

BACKGROUND OF THE INVENTION

Disposable bibs are well known in the art. Such bibs can be provided for use on babies during feeding. Disposable bibs can have a laminate construction comprising multiple layers.

One problem with securing a bib to wearer is that, in fastening the bib to the wearer, the portion of the bib covering the wearer's chest can become distorted, thereby causing the bib to gap away from the wearer's chest. This distortion can be caused by the forces applied to the bib in securing the bib about the wearer's neck. Additionally, the portion of the bib over the wearer's chest can be distorted when the wearer's arms move, such as during feeding of the wearer. Such distortion is undesirable, because it can leave a portion of the wearer unprotected from food spills, and can cause discomfort to the wearer.

Two attempts to overcome this problem are illustrated by U.S. Pat. No. 3,214,369 issued Jul. 4, 1939 to Woolever and U.S. Pat. No. 3,286,279 issued Nov. 22, 1966 to Brown. These patents disclose bibs having curved edges which form concave shapes at the longitudinal side edges of the bibs. However, these shapes are complex to produce. The irregularly shaped edges lead to difficulties, which must be accounted for in manufacturing. Furthermore, the concavities represent surface area not covered by the bibs and which can allow spilled foods to contact and soil the clothing of the wearer. One improvement upon this art is illustrated in commonly assigned U.S. Pat. No. 08/733,377 filed Oct. 17, 1996 in the name of Jackson, the disclosure of which is incorporated herein by reference.

Accordingly there is a need for a bib having the convenience of manufacture associated with straight longitudinal side edges. There is further a need for such a bib which has stress relief means to accommodate the proper fit for various sizes of wearers and wearers assuming different positions while the bib is in use.

SUMMARY OF THE INVENTION

The invention comprises a bib. The bib has a longitudinal centerline in a lateral direction orthogonal thereto. The bib has two longitudinal side edges, one disposed on each side of the longitudinal centerline. The longitudinal side edges are straight, except for stress relief means juxtaposed with each longitudinal side edge. The longitudinal side edges are collinear at positions longitudinally outward of the stress relief means.

The stress relief means provides a preferred fold line for folding of the bib in a direction generally lateral to the bib. Suitable stress relief means include notches, and particularly notches which converge towards the longitudinal centerline without a vertex. Other stress relief means include embossed areas, ring rolled areas, and structurally elastic film.

DETAILED DESCRIPTION OF THE INVENTION

Figure 1:
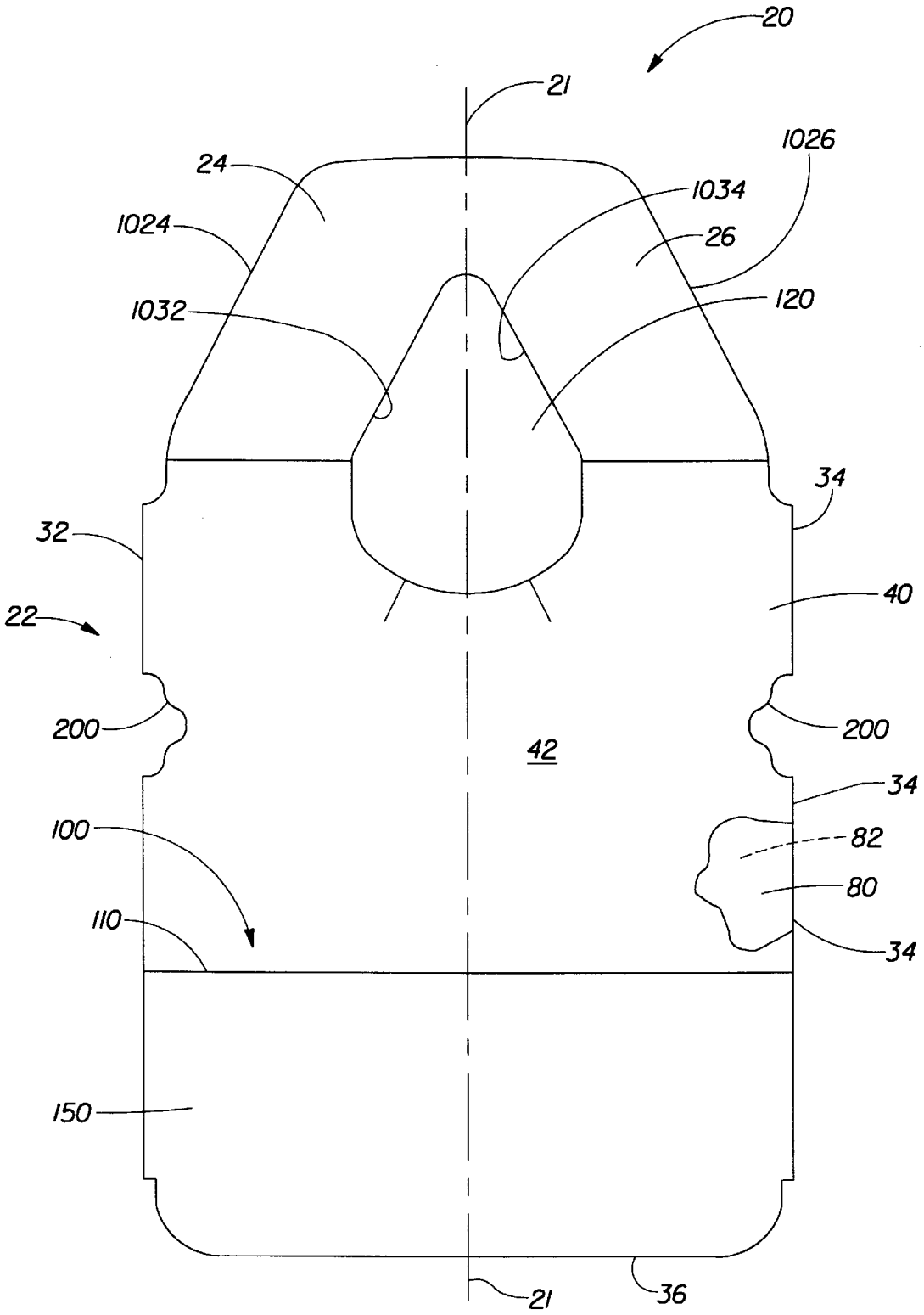
FIG. 1 is a front plan view of a bib according to the present invention, having notches and shown partially in cutaway.

FIG. 1 illustrates a disposable bib 20 according to one embodiment of the present invention. The bib 20 comprises a bib body 22 having longitudinally extending side edges 32 and 34, a longitudinal length, a longitudinal centerline 21, a laterally extending bottom edge 36, and a lateral width. The term "longitudinal" refers to an axis or direction measured along the length of the bib body 22, which direction or axis is generally parallel to a line extending from the wearer's head to the wearer's waist, as the bib 20 is worn. The terms "lateral" and "transverse" refer to an axis or direction which is perpendicular to the longitudinal centerline 21, and which is generally parallel to a line extending across the wearer's chest as the bib 20 is worn.

The bib 20 also comprises a pair of shoulder extensions 24, 26, each having a proximal end connected to the bib body 22 and a distal end spaced from the bib body 22. The distal ends of the shoulder extensions may be releasably joined together along a selective line of weakening.

The shoulder extensions 24, 26 can extend from the bib 20 such that the outward edges of the extensions 24, 26 provide at least a portion of a pair of oppositely facing, laterally spaced apart convex edges 1024 and 1026. The convex edge 1024 is adjacent to, and associated with the concave edge 1032. The convex edge 1026 is adjacent to, and associated with concave edge 1034. The portions of the shoulder extensions 24 and 26 which are bordered by the edges 1024 and 1026 extend over the wearer's shoulders to protect the wearer's shoulders from being soiled.

The shoulder extensions 24, 26 also extend from the bib body 22 to provide a generally planar neck opening 120 when the bib 20 is supported on a flat, horizontal surface. The generally planar neck opening 120 has a front neck portion, a rear neck portion, and a maximum width portion disposed intermediate the front neck portion and the rear neck portion. The neck opening 120 also has a longitudinal length measured along the longitudinal centerline 21.

The generally planar neck opening 120 is generally symmetric about a longitudinal axis, such as the longitudinal centerline 21, and is generally asymmetric about a lateral axis passing through the midpoint of the longitudinal length when the bib 20 is supported on a flat, horizontal surface. The lateral asymmetry of the neck opening 120 promotes fit about different neck sizes and shapes without slipping, while reducing the tendency of the bib body 22 to gap away from the wearer's chest when the shoulder extensions 24, 26 are overlapped behind the wearer's neck to fasten the bib 20 to the wearer.

The bib 20 can optionally include a pocket 100 for catching and receiving food particles. The pocket 100 includes a pocket open edge 110 and a pocket bottom edge. In the embodiment shown, the bib 20 also includes a pocket panel 150. The pocket panel 150 can extend from the pocket open edge 110 to the bib bottom edge 36. The pocket panel 150 can depend in a pendulous fashion from the pocket open edge 110 to provide gravitational opening of the pocket 100. U.S. Pat. No. 4,445,231 "Bib Having Gravitationally Openable Pocket" issued May 1, 1984 to Noel and U.S. patent application Ser. No. 08/513,496 "Bib Having an Improved Pocket" filed Aug. 10, 1995 in the name of Reinhart are incorporated herein by reference for the purpose of showing a bib construction for forming a bib 20 having a pocket 100 and a pocket panel 150.

The bib 20 also preferably comprises a fastening assembly for joining together the shoulder extensions 24 and 26 in an overlapping fashion, to thereby secure the bib 20 to the wearer. Suitable fastening assemblies are disclosed in commonly assigned U.S. Pat. No. 4,495,658 issued Jan. 29, 1985 to Moret et al.; U.S. Pat. No. 5,715,542 issued Feb. 10, 1998 to Reinhart, Jr. and U.S. patent Ser. No. 08/513,643 filed Aug. 10, 1995 in the name of Reinhart, Jr., the disclosure of which are incorporated herein by reference.

In one embodiment of the present invention (not shown), the bib 20 includes at least one waist fastening member. The bib 20 may include a pair of waist fastening members comprising waist fastening straps and for securing the bib 20 about the wearer's waist. The waist straps extend from the side edges 32, 34 of the bib 20 to a distal strap and the bottom edge 36.

Figure 2:
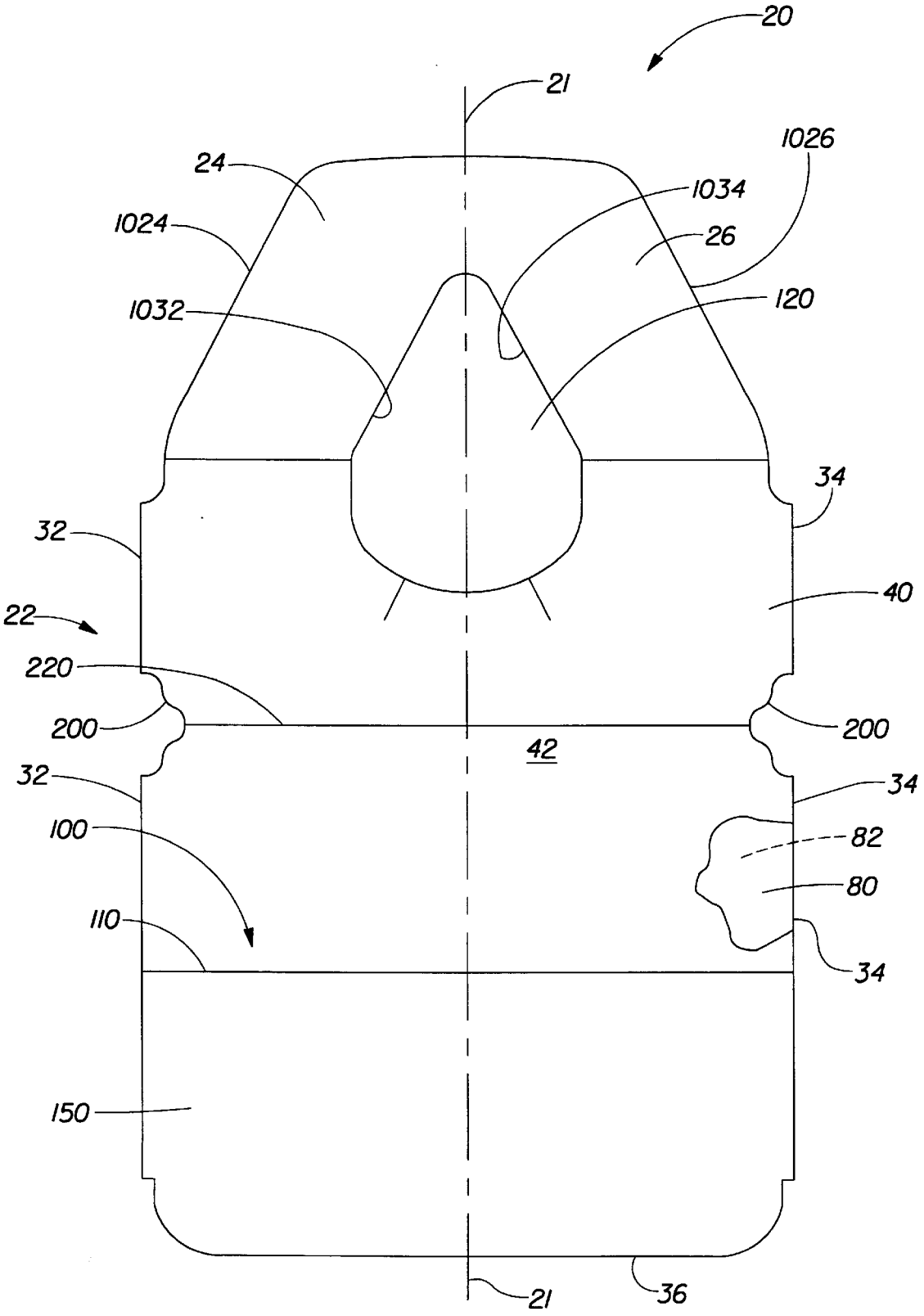
FIG. 2 is a front plan view of an alternative embodiment of a bib according to the present invention illustrating a stress relief means which extends continuously transversely across the lateral width of the bib.

Referring to the components of the bib 20 in more detail, the bib 20 according to the present invention can comprise a composite construction having multiple laminae. Referring to FIGS. 1–2, the bib 20 can comprise a laminate of an absorbent outer topsheet layer 40 and a garment facing backsheet layer 80 which is liquid impermeable relative to the topsheet 40. The topsheet 40 has a first outer surface 42 for receiving spilled food material, and a second inner surface. The backsheet 80 has a first garment facing surface 82 and a second surface. The garment facing surface 82 of the backsheet 80 and the outer surface 42 of the topsheet 40 are oppositely facing surfaces, and can be joined together, such as with an adhesive, to form a laminate. In one embodiment, the shoulder extensions 24, the bib body panel, the pocket panel 105, and the third panel are formed from a single, continuous sheet of the laminate of the topsheet 40 and the backsheet 80.

The topsheet 40 can comprise a paper web having a basis weight of from about 10 to about 50 pounds per three thousand square feet. The following commonly assigned U.S. patents are incorporated by reference for the purpose of disclosing how to make tissue paper suitable for use in making a topsheet 40: U.S. Pat. Nos. 4,191,609, 4,440,597; 4,529,480; 4,637,859; 5,223,096; and 5,240,562. A suitable topsheet 40 can be formed from a single ply or multiple ply paper towel, such as a bounty Paper Towel manufactured by The Procter and Gamble Company of Cincinnati, Ohio.

The backsheet 80 can comprise a liquid impervious polymeric film, such as a polyolefinic film. In one embodiment the backsheet 80 can comprise a polyethylene film having a thickness of between about 0.5 mil (0.0005 inch) and about 3.0 mils (0.003 inch). In one embodiment the backsheet can comprise a FS-II embossed polyethylene film having a thickness of about 2 mils and manufactured under the designation CPC-2 (P-10392) by Tredegar Film Products of Cincinnati, Ohio.

The topsheet 40 can be joined to the backsheet 80 in any suitable manner, including but not limited to methods such as adhesive bonding, mechanical bonding, and ultrasonic bonding. A suitable adhesive for joining the topsheet 40 and the backsheet 80 is a hot melt adhesive such as a hot melt pressure sensitive adhesive. Adhesives suitable for joining the topsheet 40 to the backsheet 80 are HL-1258 and HL-1262 adhesives, manufactured by H. B. Fuller Co. of St. Paul, Minn. Other suitable adhesives include Findley Adhesives H2031 and H2120 available from Findley Adhesives of Elmgrove, Wis.

The bib 20 according to the present invention has two longitudinally extending side edges 32, 34, one on each of the side of the longitudinal centerline 21. The longitudinally extending side edges 32, 34 are straight, except for the stress relief means 200 as discussed below. It will be understood the converging or diverging side edges 32, 34 are contemplated and within the scope of the present invention, as a lesser preferred embodiment due to the manufacturing complications and a waste of material which can arise.

The longitudinal side edges 32, 34 are interrupted by stress relief means 200. The stress relief means 200 represent discontinuities in the longitudinal side edges 32, 34 greater than the normal asperities, rugosities and irregularities which are incident to and expected in the manufacturing process. The stress relief means 200 comprise any feature exposed on or juxtaposed with the longitudinal side edges 32, 34 of the bib 20 and which predispose the bib 20 to bending, folding or yielding at a position juxtaposed with or coincident the stress relief means 200. Preferably, the bending, or yielding folding occurs along a fold line or axis extending in, and more preferably generally parallel to the transverse direction.

The stress relief means 200 may provide any line of weakness across the bib 20 in the transverse direction and which allows the bib 20 to hinge or fold along this line of weakness. For example, by selectively reducing the cross section of the bib 20 at a predetermined longitudinal position, the bib 20 will be more likely to bend about a transverse line coincident the reduced cross section than a nearby transverse line having a greater cross section. Preferably each stress relief 200, means extends inwardly from the longitudinal side edge 32, 34 of the bib 20 about 10 to about 25% of the distance from the longitudinal side edge 32, 34 to the longitudinal centerline 21 of the bib 20.

The stress relief means 200 may be juxtaposed with the longitudinal side edges 32, 34 of the bib 20. Suitable stress relief means 200 include notches, cutouts and relieved areas. The notches may be V-shaped, U-shaped or have a more complex shape, as illustrated. If a notch is selected, preferably the notch converges as the longitudinal centerline 21 is approached. Such convergence provides the benefit of focusing the hinge line at a predetermined longitudinal point on the bib 20. Slits are also contemplated as a less preferred execution of a notch and are within the scope of the present invention. It is to be recognized that notches comprising slits or having a V-shape are less preferred. Such notches converge to a vertex inboard to the longitudinal side edges 32, 34 of the bib 20. Such vertices provide tear points for the bib 20, allowing it to be more readily torn into two pieces or torn such that the wearer is exposed at the tear line.

Preferably the notches are symmetrically opposite about the longitudinal centerline 21 and are disposed at the same longitudinal position on the bib 20. Preferably the stress relief means 200 are disposed in the upper half of the bib 20, as measured between the lowest point of the neck opening and the bottom edge of the bib 20.

Referring to FIG. 2, in an alternative embodiment of the invention, the bib 20 may have stress relief means 220 which extend essentially continuously across the lateral width of the bib 20. Such continuous stress relief means 220 may constitute creases, score lines, perforations, or other hinge lines for predisposing the bib 20 to fold at the predetermined location. Preferably, any such stress relief means 220 extends generally laterally across the bib 20 and intercept the longitudinal side edges 32, 34.

Figure 3:
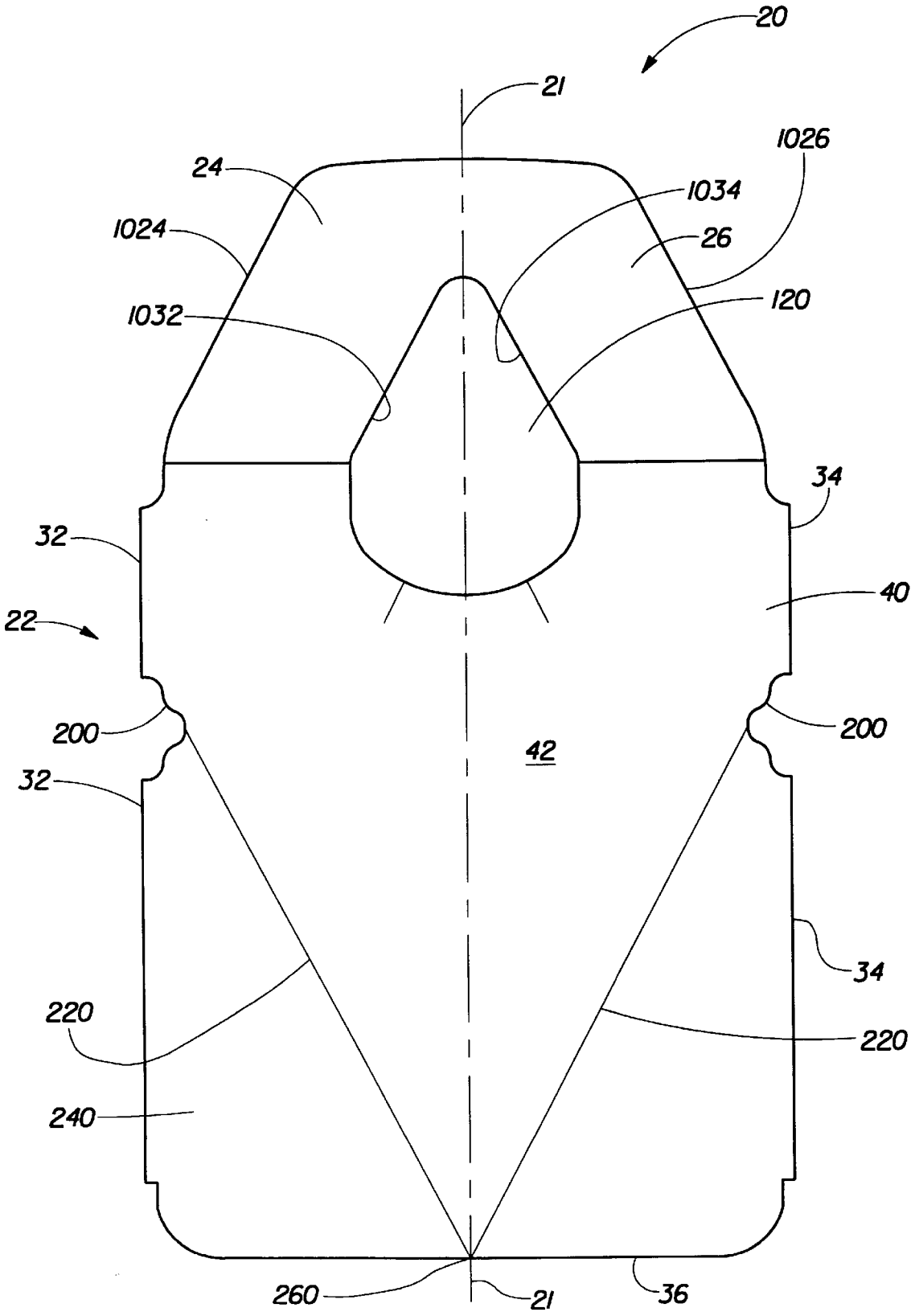
FIG. 3 is a front plan view of another alternative embodiment of a bib according to the present invention without a pocket and having stress relief means with vector components in both the longitudinal and transverse directions and which converge at the longitudinal centerline.

Referring to FIG. 3, it is not necessary that the hinge lines or other continuous stress relief means 220 which extend continuously across the bib 20 be parallel the transverse direction. Instead, stress relief means 200 may extend laterally outwardly from any point coincident the longitudinal centerline 21. In a preferred embodiment stress relief means 200 diverge outwardly from the point 260 coincident the intersection of the longitudinal centerline 21 and the bottom edge 36 of the bib 20 to the two longitudinal side edges 32, 34 of the bib 20. It will be recognized this may produce a concave upwards configuration, as shown, or a concave downwards configuration. Such stress relief means 200 may be rectilinear, as shown, or curvilinear.

This geometry provides for folding of the two bottom comers of the bib 20 and allows for these portions of the bib 20 to conform to the wearer as he or she is seated. These portions of the bib 20 so folded may represent triangles 240, or other three sided shapes generally resembling triangles 240. Thus, in the embodiment of FIG. 3, the continuous stress relief means 220 extend from the longitudinal centerline 21, diverging upwardly and outwardly towards the point where this stress relief means 200 intercept the longitudinal side edges 32, 34. This arrangement provides the benefit that the bib 20 not only folds about a line oriented in the transverse direction, but also provides for folding about the longitudinal centerline 21.

Figure 4:
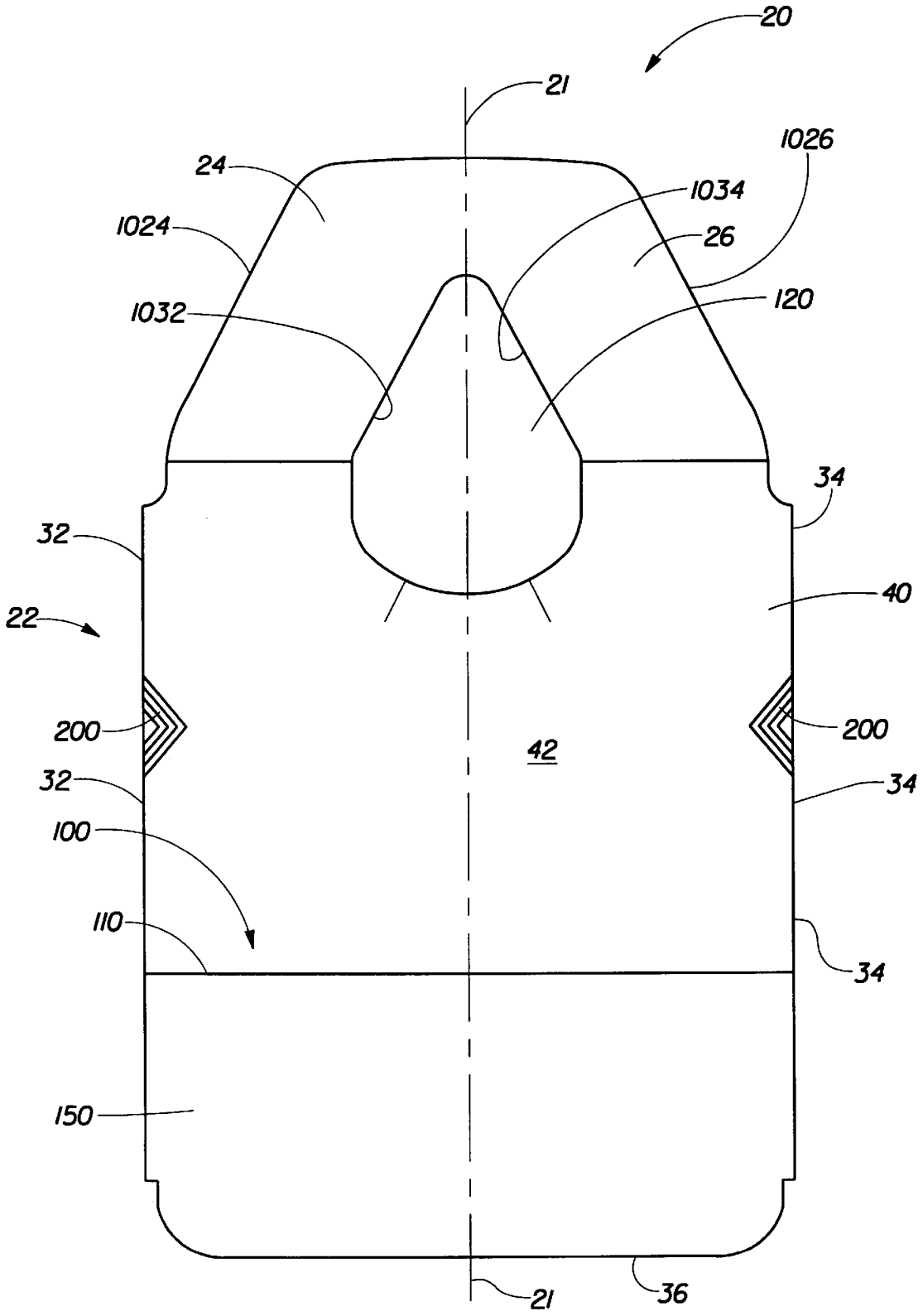
FIG. 4 is a front plan view of an alternative embodiment of a bib according to the present invention illustrating a stress relief means having an embossed chevron pattern.

Referring to FIG. 4, the stress relief means 200 may comprise embossments, structural elastic film or ring rolled material. Embossments and ring rolling are well known in the art and may be provided in any pattern which provides a hinge line having a vector component perpendicular to the longitudinal centerline 21 of the bib 20. Suitable embossment patterns include chevrons. The chevrons may converge from the longitudinal side edges 32, 34 of the bib 20 towards the longitudinal centerline 21. Structural elastic film may be made according to commonly assigned U.S. Pat. No. 5,518,801 issued May 21, 1996 to Chappell et al. the disclosure of which is incorporated herein by reference.

It will be apparent that various combinations the foregoing types of constructions and stress relief means 200 may be incorporated into the bib 20.

What is claimed is:

1. A bib, said bib comprising a neck opening defined by two shoulder straps, said bib having a longitudinal centerline and a lateral direction orthogonal thereto, said bib having two longitudinal side edges, one of said longitudinal side edges being disposed on each side of said longitudinal centerline, said longitudinal side edges defining a lateral width therebetween, said longitudinal side edges being straight except for a stress relief means juxtaposed with each of said longitudinal side edges, said longitudinal side edges being collinear longitudinally outboard of said stress relief means, said stress relief means comprising a preferred fold line for folding of said bib about a fold line having a generally transverse orientation and extending substantially throughout said entire lateral width of said bib.

2. A bib, said bib comprising a neck opening defined by two shoulder straps, said bib having a longitudinal centerline and a lateral direction orthogonal thereto, said bib having two longitudinal side edges, one of said longitudinal side edges being disposed on each side of said longitudinal centerline, said longitudinal side edges being straight except for a convergent stress relief means juxtaposed with each of said longitudinal side edges, said longitudinal side edges being collinear longitudinally outboard of said stress relief means, said stress relief means comprising an apex oriented towards said longitudinal center line.

3. A bib according to claims 1 or 2 wherein said stress relief means comprises notches.

4. A bib according to claim 3 wherein said notches converge as said longitudinal centerline is approached.

5. A bib according to claim 1 wherein said relief means comprise perforations.

6. A bib according to claim 1 wherein said stress relief means extends from a point coincident said longitudinal centerline of said bib and diverges outwardly therefrom to said stress relief means juxtaposed with said longitudinal side edges of said bib.

7. A bib according to claim 6 having a bottom edge, and wherein said stress relief means extends from a point juxtaposed with the intersection of said longitudinal centerline and said bottom edge of said bib and diverges outwardly therefrom to said stress relief means juxtaposed with said longitudinal side edges of said bib.

8. A bib according to claims 1 or 2 wherein said stress relief means comprises embossed regions.

9. A bib according to claim 8 wherein said embossed regions comprise a chevron pattern.

10. A bib according to claims 1 or 2 wherein said stress relief means comprises structural elastic film.

11. A bib according to claim 2 having an area of reduced cross section juxtaposed with said stress relief means.

* * * * *